US006301926B1

(12) United States Patent
Avequin et al.

(10) Patent No.: US 6,301,926 B1
(45) Date of Patent: Oct. 16, 2001

(54) CONDENSER, INCLUDING A RESERVOIR, MOUNTED ON A BASE IN SUCH A WAY AS TO BE REMOVABLE AND WATERTIGHT

(75) Inventors: Stéphane Avequin, Versailles; André Paquet, Gueux, both of (FR)

(73) Assignee: Valeo Thermique Moteur (FR)

( * ) Notice: Subject to any disclaimer, the term of this patent is extended or adjusted under 35 U.S.C. 154(b) by 0 days.

(21) Appl. No.: 09/671,613

(22) Filed: Sep. 28, 2000

(30) Foreign Application Priority Data

Sep. 28, 1999 (FR) ..... 99 12078

(51) Int. Cl.[7] ..... F25B 39/04
(52) U.S. Cl. ..... 62/509; 62/512; 165/132
(58) Field of Search ..... 62/509, 512, 507, 62/474; 165/132, 174, 175

(56) References Cited

U.S. PATENT DOCUMENTS 5,505,253 * 4/1996 Heraud ..... 165/132
5,537,839 * 7/1996 Burk et al. ..... 62/474
5,896,754 * 4/1999 Balthazard et al. ..... 62/507
5,934,102 * 8/1999 DeKeuster et al. ..... 62/509
5,946,938 * 9/1999 Balthazard et al. ..... 62/507
5,974,828 * 11/1999 Guerand ..... 62/509
5,988,267 * 11/1999 Park et al. ..... 165/174
6,038,884 * 3/2000 Dabrowski ..... 62/509
6,145,339 * 11/2000 Pomme et al. ..... 62/509
6,158,503 * 12/2000 Gille et al. ..... 165/132
6,170,287 * 1/2001 Leitch et al. ..... 62/474
6,209,349 * 4/2001 Hu et al. ..... 62/509
6,223,556 * 5/2001 DeKeuster et al. ..... 62/509

FOREIGN PATENT DOCUMENTS

0915307 A 5/1999 (EP) .
0931982 A 7/1999 (EP) .
1312782 A 4/1973 (GB) .

* cited by examiner

*Primary Examiner*—Teresa Walberg
*Assistant Examiner*—Fadi H. Dahbour
(74) *Attorney, Agent, or Firm*—Liniak, Berenato, Longacre & White

(57) ABSTRACT

A reservoir is screwed axially into a base, itself brazed to a collecting compartment of the condenser. It is linked to the former by means of channels recessed into the base. The threads securing the reservoir are protected from any contact with the refrigerating fluid by sealing rings and from external attack by a sleeve covering the outside of the junction area between the reservoir and the base.

Applied to air-conditioning application for automobile passenger compartments.

6 Claims, 1 Drawing Sheet

CONDENSER, INCLUDING A RESERVOIR, MOUNTED ON A BASE IN SUCH A WAY AS TO BE REMOVABLE AND WATERTIGHT

FIELD OF THE INVENTION

The invention concerns a condenser, in particular for a refrigerating fluid in an air conditioning device for the passenger compartment of an automobile, comprising a collection compartment and an intermediate reservoir, for the treatment and/or accumulation of a fluid, with channels linking it to the collection compartment.

BACKGROUND OF THE INVENTION

As is well known, the intermediate reservoir in such a condenser can perform some or all of the following functions: filtration and/or dehydration of the refrigerating fluid, compensation for variations in its volume, and separation of the gaseous and liquid phases. Interposing it between upstream and downstream sections of the condenser ensures the fluid in the latter circulates only in the liquid state, which is thus supercooled to a point below the temperature at which the liquid changes to a gas, improving the performance of the condenser and making the former relatively independent of the amount of fluid contained in the circuit.

EP-A-0 480 330 describes an intermediate reservoir in a vehicle air conditioning condenser secured, so as to be removable, to a base fixedly attached to the collection compartment and traversed by two connecting channels. This reservoir is fitted at its lower end with a head embodied in its wall, which is secured to the base by means of a screw. The connecting channels extend partly into the base and partly into the reservoir head.

This conventional configuration is relatively complex and cumbersome. Furthermore, to replace the reservoir, it is necessary to slacken the fixing screw, which can generate serious difficulties related to accessibility within the vehicle.

one aim of the invention is to enable these disadvantages to be at least partly remedied.

Embodiments of the invention permit simple, convenient methods of fixing the reservoir to the base, thus ensuring these are protected against interior and exterior forces.

SUMMARY OF THE INVENTION

According to the present invention there is provided a condenser, in particular for a refrigerating fluid in an air conditioning device for the passenger compartment of an automobile, comprising a collection compartment and intermediate reservoir for the treatment and/or Accumulation of a fluid, secured in such a way that it can be removed to a base which is fixedly attached to the collection compartment and traversed by two connecting channels for transferring fluid between the collection compartment and the reservoir, the reservoir and the base having matching threaded surfaces which are joined together to secure the reservoir to the base, with at least one sealing ring preventing the fluid contained in the reservoir from coming into contact with the said threaded surfaces and an additional stopping element protecting the former from external corrosive agents, wherein the topping element is a sleeve covering tightly two surface portions turned radially outwards, belonging to the reservoir and the base respectively and located next to each other in the axial direction.

The invention basically comprises a condenser with a collection compartment and an intermediate reservoir for the treatment and/or accumulation of a fluid, which is fixed to the base incorporated in the collection compartment so as to be removable, traversed by two connecting channels for transferring fluid between the collection compartment and the reservoir.

In accordance with the present invention, the reservoir and the base have matching threaded surfaces which interconnect to secure the reservoir on the base, at least one sealing ring preventing the fluid contained in the reservoir from coming into contact with the said threaded surfaces, and an inset stopping element protecting the former from external corrosive agents.

Some optional features of the invention, additional or alternative, are set out below:

The sealing ring is coaxial with the said threaded surfaces.

The said stopping element is coaxial with the said threaded surfaces.

The said stopping element is an elastic ring fitted axially between the surfaces of the reservoir and the base.

The stopping element is a sleeve which just covers two portions of the surface, turned radially outwards, belonging to the reservoir and the base respectively, meeting in the axial direction, the said portions of the surface being joined to the said threaded surfaces by quick-release fittings.

The sleeve is fitted tightly to the said portion of the reservoir surface and covers the said portion of the surface of the base loosely.

The threaded reservoir surface is an external surface joined to the said portion of the reservoir surface by a shoulder, the threaded surface and the said surface portion of the base being provided on the internal and external faces of an annular wall, adjacent to a free axial end of the former.

On its inner face, the sleeve has an annular rib fitting between the said collar and the said free end.

BRIEF DESCRIPTION OF THE DRAWINGS

Features and advantages of the invention will be described in greater detail in the following paragraphs, with reference to the accompanying drawings, in which.

DESCRIPTION OF THE PREFERRED EMBODIMENT

Figure 1:
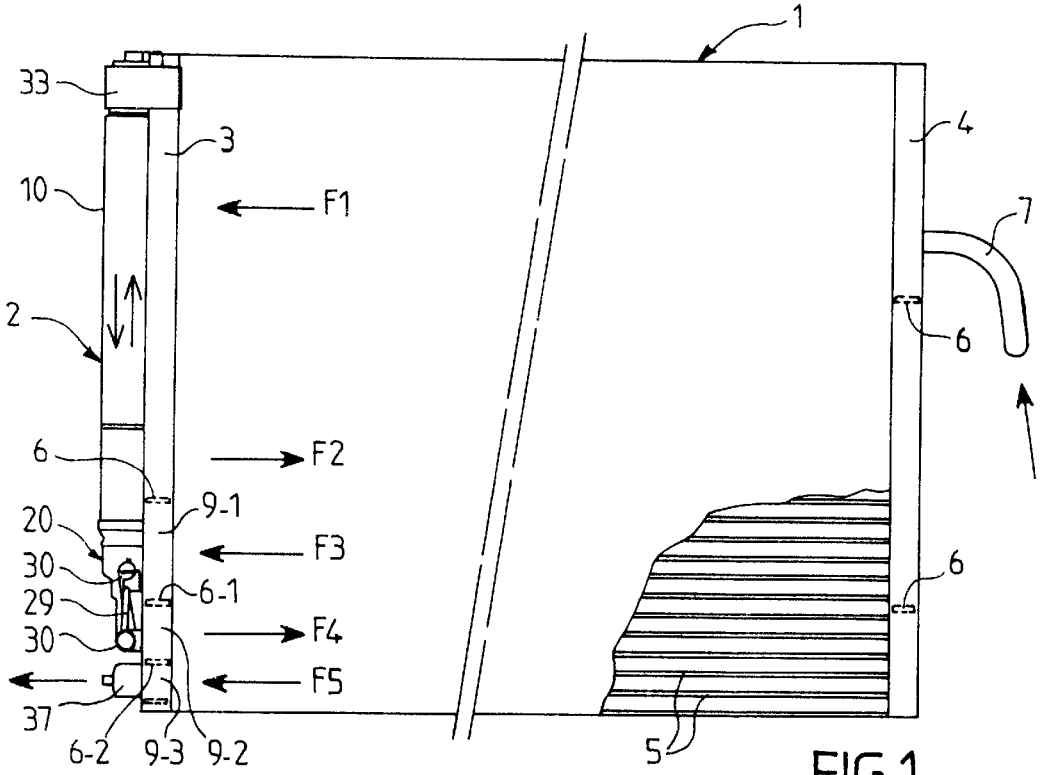
FIG. 1 is a front elevation of a condenser in accordance with the invention.

In the various figures, like reference numerals refer to like parts.

Condenser 1, represented in its entirety in FIG. 1, comprises two collection compartments 3, 4 aligned vertically and separated horizontally from each other, linked by numerous horizontal fluid circulation tubes 5. Each collection compartment is divided into various chambers by means of horizontal partitions 6 such that the fluid circulates, in the tubes 5, alternately from a chamber in compartment 3 to a chamber in compartment 4 and, conversely, from the upper chamber in compartment 4, which is linked to an entry manifold 7, to the lower chamber in compartment 3.

One of the intermediate partitions in collection compartment 3, designated by reference 6-1, divides chamber 9-1 and chamber 9-2, situated above and below partition 6-1 respectively, from each other, and these are interconnected exclusively by means of a reservoir 2, which is aligned vertically and extends along the full length of compartment 3. Chamber 9-2 is in turn divided from the lower chamber of the compartment, designated by reference 9-3, by a partition 6-2.

Reservoir 2, which exhibits approximately a circular symmetry about a vertical axis A, comprises a housing made up of a cylindrical body 10, which forms the major part of its height, and a narrow collar 11 located on its lower part. In its turn, the collar 11 is subdivided from top to bottom into three parts 12, 13 and 14 decreasing in diameter, interconnected by means of radial shoulders, the intermediate region 13 being fitted with a male thread and the lower region 14 having two circumferential grooves formed in it in which are seated two sealing rings 15. The collar is traversed by an axial manifold 17 which projects upwards inside the reservoir and downwards externally. The annular volume 18 contained between the lateral wall of body 10 and the tubing 17 holds cleaning agents for filtering and/or dehydrating the fluid circulating in the condenser.

For the purpose of fluid transmission, reservoir 2 is linked mechanically with collection compartment 3 via a base 20. This base is for choice a moulded aluminium alloy component, defining a wall 21 approximately centred around an axis A, which delimits a housing 23 open at its top end for the purpose of receiving the collar of reservoir 2. The lateral surface of housing 23 has in its upper area 24 a female thread matching the thread in area 13 of the reservoir to provide coaxial fixing of the latter on the base. A cylindrical median region 25 of the wall 21 fits into the sealing rings 15, and a lower cylindrical region 26, extending below the free end of collar 11, surrounds the manifold 17 and delimits an annular space with the latter, the free end of which rests on a seating 27 provided at the base of housing 23, by means of a sealing lip 28. A supporting tie 33 links the upper end of reservoir 2 mechanically to that of collection compartment 3 to provide a more stable fixing for the reservoir.

A fin 29 is attached to the outer surface of wall 21, in a plane extending approximately through the axis A. This fin has bulges 30 on both sides which accommodate two channels 31, 32 aligned parallel to this plane. In an intermediate stage during manufacture of the base, the ends of channel 31 open in housing 23 at the level of the aforementioned annular space, and on the free side of fin 29, respectively, and channel 31 is inclined upwards from the former end to the latter one. Channel 32 extends horizontally from the free side of the fin to below the housing 23, where it bends upwards to emerge at the bottom thereof, inside the annular seating 27. In the finished base, brazed plugs 35, 36 provide sealing for the free ends of channels 31, 32 and these emerge on the outside solely via passages recessed into lateral bosses formed on the bulges 30.

The base 20 is secured to the collection compartment 3 by brazing the aforementioned lateral bosses to the outer surface of the tubular wall made of sheet aluminium forming the compartment, during the assembly of the condenser by brazing. The recessed passages in the lateral bosses are linked to chambers 9-1 and 9-2 of the compartment respectively by holes provided in the tubular wall, in which nozzles provided for this purpose engage. The fluid entering the upper chamber of collection compartment 4 via the manifold 7 passes through a first group of tubes as shown by the arrow F1 to reach the upper chamber of compartment 3, then through two other groups of tubes as shown by arrows F2 and F3, in order to enter the intermediate chamber of compartment 4 and chamber 9-1 of compartment 3. The condensed fluid thus reaching chamber 9-1 passes from the former into the annular space 23 in the base via a lateral passage and via the sloping channel 31, then enters reservoir 2, which is screwed into the base, passing outside the manifold 17. It then traverses the annular volume 18 where it is dehydrated and filtered. The fluid leaves volume 18 via the manifold 17, reaching the chamber 9-2 of collection compartment 3 via horizontal channel 32 and the matching lateral passage in the base. In this way, the tubes 5 and the chambers of compartments 3 and 4 situated above partition 6-1, including chamber 91, form a section of the condenser through which the fluid upstream of the reservoir passes, whereas the tubes and chambers situated below this partition, including chamber 9-2, form a downstream section. Fluid passes from chamber 9-2 to the lower chamber of collection compartment 4 as shown by the arrow F4 and is then routed to chamber 9-3 as shown by the arrow F5. Fluid leaves this last chamber and the condenser via manifold 37.

Figure 2:
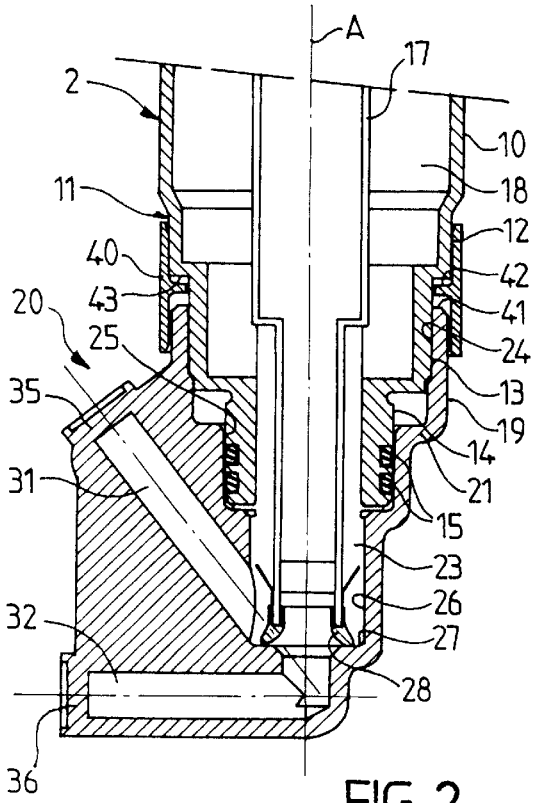
FIGS. 2 and 3 are sectional views along the base and the lower part of the reservoir, each associated with a different method of manufacturing the condenser.

The sealing rings 15 guarantee fluid-fast separation between the interior and exterior of the refrigerating fluid circuit at the junction of reservoir 2 and base 20. They thus protect the threaded surfaces 13, 24 against any contact with the fluid. Moreover, to protect these same threaded surfaces against external corrosive agents, a sleeve 40, in the embodiment shown in FIG. 2, is provided, formed for example from a piece of moulded plastic, secured to the reservoir by fitting in the area 12 of the collar. Sleeve 40 projects downwards beyond area 12 to cover tightly the outer surface 19 of the annular wall 21 in the base, next to its free end 41. It has a rib 42 projecting radially towards the inside, between the edge 41 and the shoulder 43 which links areas 12 and 13 of the reservoir collar. The sleeve thus forms a baffle between the outside and the threaded surfaces 13, 24 protecting the former against projections.

Figure 3:
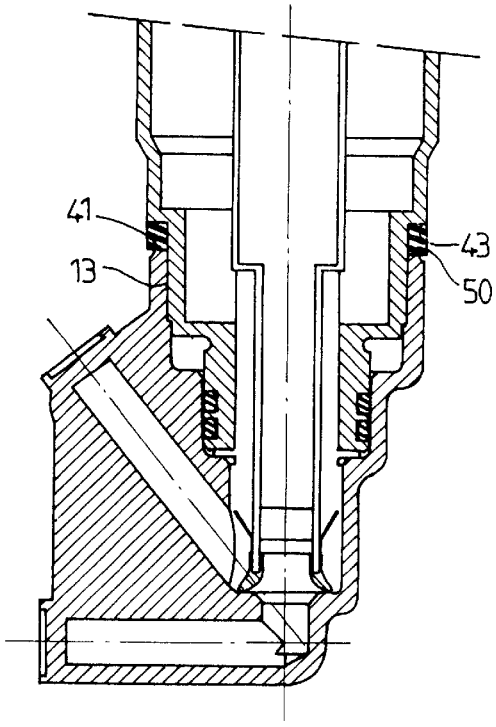

In the variant shown in FIG. 3, the reservoir and the base are identical to those in FIG. 2, the reference signs relating to their various elements not being repeated. Sleeve 40 is replaced by an elastomer ring 50 surrounding the area 13 of the collar, above the threading thereof, which can be clamped axially, when the reservoir is screwed, between the edge 41 and the collar 43.

What we claim is:

1. A condenser, in particular for a refrigerating fluid in an air conditioning device for the passenger compartment of an automobile, comprising a collection compartment and intermediate reservoir for the treatment and/or accumulation of a fluid, secured in such a way that it can be removed to a base which is fixedly attached to the collection compartment and traversed by two connecting channels for transferring fluid between the collection compartment and the reservoir, the reservoir and the base having matching threaded surfaces which are joined together to secure the reservoir to the base, with at least one sealing ring preventing the fluid contained in the reservoir from coming into contact with the said threaded surfaces and an additional stopping element protecting the former from external corrosive agents, wherein the stopping element is a sleeve covering tightly two surface portions turned radially outwards, belonging to the reservoir and the base respectively and located next to each other in the axial direction.

2. The condenser of claim 1, wherein the sealing ring is coaxial with the threaded surfaces.

3. The condenser of claim 1, wherein the stopping element is coaxial with the threaded surfaces.

4. The condenser of claim 1, wherein the sleeve is closely fit to the said portion of the reservoir surface and loosely covers the said portion of the surface of the base.

5. The condenser of claim 1, wherein the threaded surface of the reservoir is an outer surface connected to the said portion of the reservoir surface via a shoulder, the threaded surface and the said portion of the surface of the base being provided on the internal and external faces of an annular wall, adjacent to a free axial end of the former.

6. The condenser of claim 5, wherein the sleeve has an annular rib on its inner face fitting between the said collar and the said free end.

* * * * *